United States Patent [19]

Nagai et al.

[11] Patent Number: 4,704,931

[45] Date of Patent: Nov. 10, 1987

[54] ACOUSTIC TONE INHIBITING MEANS FOR KEYBOARD MUSICAL INSTRUMENT

[75] Inventors: Yohei Nagai; Yoshimasa Isozaki, both of Hamamatsu, Japan

[73] Assignee: Nippon Gakki Seizo Kabushiki Kaisha, Shizuoka, Japan

[21] Appl. No.: 874,589

[22] Filed: Jun. 16, 1986

[30] Foreign Application Priority Data

Jun. 17, 1985 [JP] Japan ..... 60-131611

[51] Int. Cl.[4] ..... G10C 5/00; G10F 1/22; G10H 5/00

[52] U.S. Cl. ..... 84/1.01; 84/2; 84/3; 84/171; 84/172

[58] Field of Search ..... 84/1.01, 2, 3, 170–172

[56] References Cited

U.S. PATENT DOCUMENTS 2,250,065 7/1941 Koehl .
2,933,004 4/1960 Hanert .

*Primary Examiner*—S. J. Witkowski
*Attorney, Agent, or Firm*—Blakely, Sokoloff, Taylor & Zafman

[57] ABSTRACT

A keyboard musical instrument includes: a keyboard; an acoustic musical tone production mechanism for generating an acoustic musical tone; a tone generator for generating an electronic musical tone; a solenoid driver for inhibiting generation of the acoustic musical tone from the acoustic musical tone production mechanism; and an operation panel for designating a musical tone to be inhibited. When a player designates a musical tone to be inhibited via the operation panel in advance and then depresses a key on the keyboard, the generation of the acoustic musical tone is inhibited by means of the solenoid driver.

4 Claims, 14 Drawing Figures

| SS 1 | SS 2 | SS 3 | SS 4 | SPLIT POINT BASS | SPLIT POINT TREBLE |
|---|---|---|---|---|---|
| ON | OFF | OFF | ON | P | E |
| OFF | ON | ON | OFF | E | P |
| ON | ON | OFF | ON | P+E | E |
| ON | ON | ON | ON | P+E | P+E |
| ON | OFF | ON | ON | P | P+E |
| OFF | ON | ON | ON | E | P+E |

| | |
|---|---|
| MODR | MODE REGISTER |
| KCR | KEY SCAN REGISTER |
| SPKCR | SPLIT POINT REGISTER |
| SSR 1 | SWITCH REGISTER |
| SSR 2 | • |
| SSR 3 | • |
| SSR 4 | • |
| DKCR | DAMP REGISTER |
| KSR | KEY STATE REGISTER |
| CHAR | CHANNEL ASSIGNMENT REGISTER |
| TEPR | TEMPORARY STORAGE REGISTER |

FIG.8

| | KC | KON | |
|---|---|---|---|
| CH 1 | ---------- | 0 | R-1 |
| CH 2 | ---------- | 1 | R-2 |
| CH 3 | ---------- | 1 | R-3 |
| ⋮ | ⋮ | ⋮ | ⋮ |
| CH N | | 0 | R-N |

FIG.9

ACOUSTIC TONE INHIBITING MEANS FOR KEYBOARD MUSICAL INSTRUMENT

BACKGROUND OF THE INVENTION

The present invention relates to a keyboard musical instrument having a means for generating an acoustic musical tone and a means for generating an electronic musical tone.

A piano and an electronic musical instrument are combined as a keyboard musical instrument to simultaneously produce piano and electronic musical tones upon depression of keys on a single keyboard (U.S. Pat. Nos. 2,250,065 and 2,933,004).

In a conventional keyboard musical instrument of this type, however, either simultaneous production of piano and electronic musical tones or production of only piano tones can be selected. The following operations cannot be performed. For example, if a player depresses keys in the bass range, piano tones can be produced; and if the player depresses keys in the treble range, electronic musical tones are produced. In addition, if the player depresses keys in the bass range, piano and electronic musical tones are produced; and if the player depresses keys in the treble range, only piano tones are produced. Therefore, play modes are limited in the conventional keyboard musical instrument of this type, resulting in poor flexibility.

SUMMARY OF THE INVENTION

It is a principal object of the present invention to provide a keyboard musical instrument for producing various tones by arbitrary combinations of acoustic and electronic musical tones, thereby increasing the variety of musical expressions.

It is another object of the present invention to provide a keyboard musical instrument wherein acoustic and electronic musical tones can be produced in units of key ranges, thereby increasing the variety of musical expressions.

In order to achieve the above objects of the present invention, there is provided a keyboard musical instrument comprising: a keyboard having a plurality of keys; acoustic musical tone generating means for generating an acoustic musical tone by using a mechanical mechanism upon operation of a key; electronic musical tone generating means for generating an electronic musical tone upon operation of a key; tone designating means for designating a musical tone to be inhibited; and acoustic tone inhibiting means for inhibiting generation of the acoustic musical tone from the acoustic musical tone generating means when the designated musical tone is the acoustic musical tone.

BRIEF DESCRIPTION OF THE DRAWINGS

FIG. 8 is a data table showing registers in a RAM 40 of FIG. 1;

FIG. 9 is a data table of channel assignment register CHAR in FIG. 8;

DESCRIPTION OF THE PREFERRED EMBODIMENT

Figure 1:
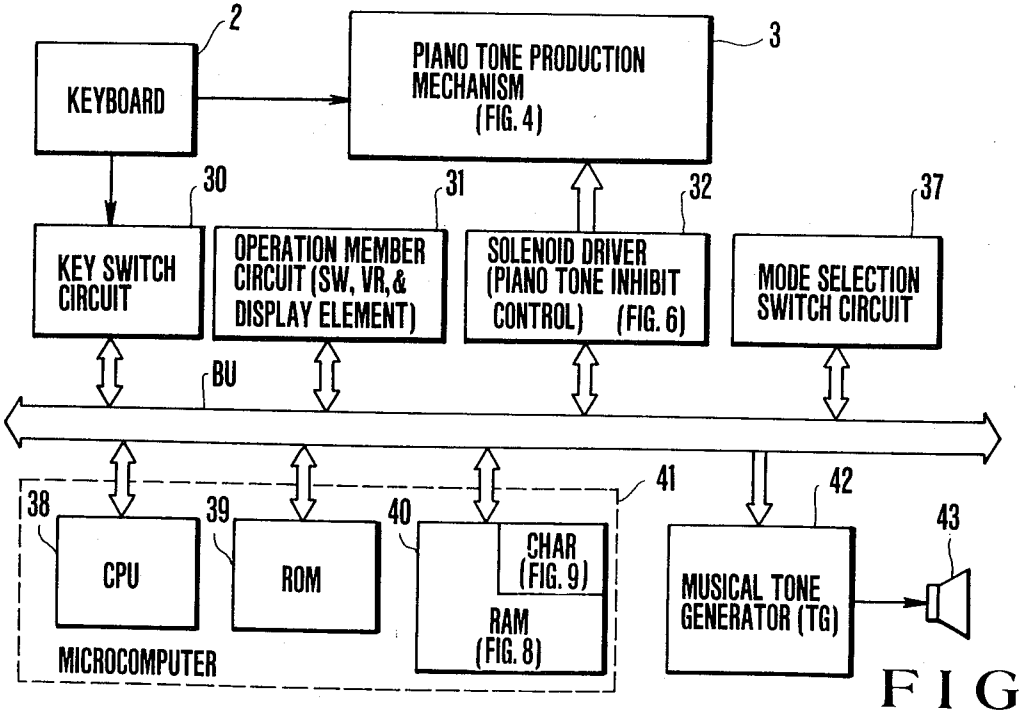
FIG. 1 is a block diagram showing an electronic musical instrument according to an embodiment of the present invention.

FIG. 1 shows an arrangement of a keyboard musical instrument. The keyboard musical instrument is constituted by incorporating an electronic musical tone generating means and a control means in a piano. An operation panel 1 is arranged at a position easily accessible to a player. The keyboard musical instrument also includes an operation panel with switches for setting tone colors and musical effects for the electronic musical tones.

The keyboard musical instrument has the following four operation modes:

(1) Split Point Input Mode

A split point (to be described later) is written in an internal register. An indicator lamp L1 is turned on upon depression of a switch S1 on the operation panel 1, and the split point input mode is then set. When a player depresses a desired key, a key code corresponding to the depressed key is written as a split point in the register.

(2) Piano Play Mode

An indicator lamp L2 is turned on upon depression of a switch S2 and this mode is then set. If the player depresses keys on the keyboard in the piano play mode, only piano tones are produced.

(3) Electronic Musical Instrument Play Mode

An indicator lamp L3 is turned on upon depression of a switch S3 and this mode is then set. If the player depresses keys on the keyboard in the electronic musical instrument play mode, only electronic musical tones are automatically produced.

(4) Split Play Mode

Figures 2, 3:
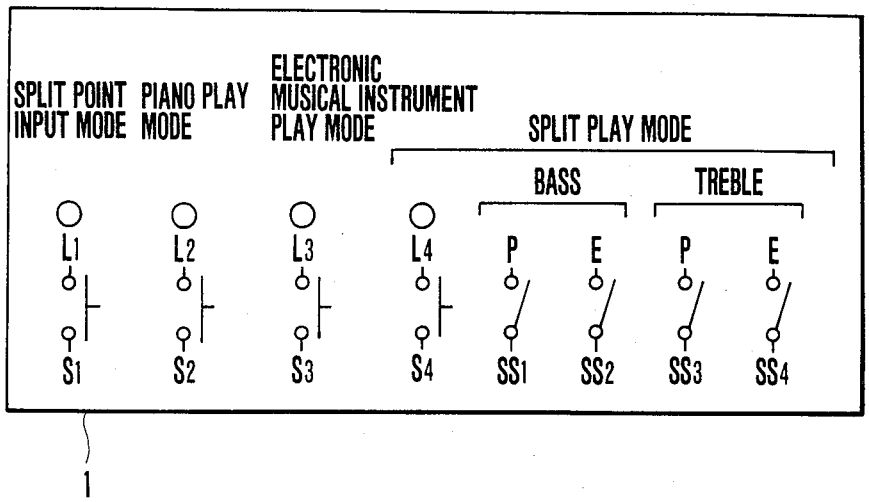
FIG. 2 is a plan view of an operation panel arranged in the musical instrument of FIG. 1.
FIG. 3 is a view showing the relationship between the operation states of switches SS1 to SS4 and the produced musical tones.

An indicator lamp L3 is turned on upon depression of a switch S4 and this mode is then set. In the split play mode, different types of tones (i.e., piano and electronic musical tones) can be produced from the bass and treble sections split by the above split point. Tone setting is performed by switches SS1 to SS4 on the operation panel 1. The relationship between the produced tones and the operation states of the switches SS1 to SS4 is shown in FIG. 3. It should be noted that "P" represents a piano tone and "E" represents an electronic musical tone.

The piano or electronic musical instrument play mode can be set according to the corresponding operation states of the switches SS1 to SS4. The switches S1 to S4 are self-return switches and the switches SS1 to SS4 are self-holding switches.

The detailed arrangement of the keyboard musical instrument will be described below.

Figures 4, 5:
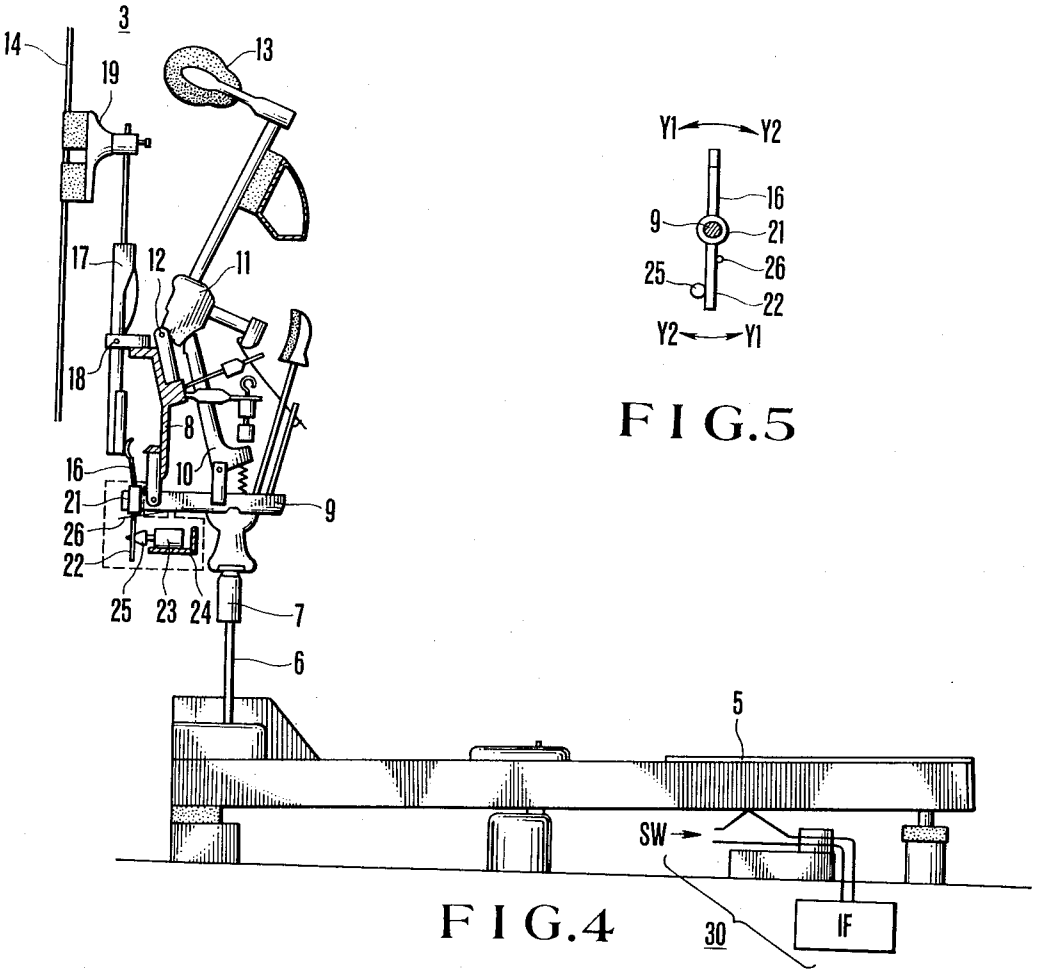
FIG. 4 is a sectional view showing an arrangement of a piano tone production mechanism 3 in FIG. 1.
FIG. 5 is a sectional view of a hatched portion in FIG. 4 when viewed from the left.

Referring to FIG. 1, a keyboard 2 has 88 keys. A piano tone production mechanism 3 is driven by each key. The detailed arrangement of the piano tone production mechanism 3 is shown in FIG. 4. The mechanism 3 in FIG. 4 is exemplified by one in an upright piano. Thus, the piano tone production mechanism 3 in FIG. 4 is the same as that of an acoustic upright piano, except for the hatched portion. If the player depresses a key 5 (right side in FIG. 4), the rear end of the key 5 (left side in FIG. 4) is moved upward. A post wire 6 and a capstan button 7 are moved upward accordingly. Upon upward movement of the capstan button 7, the other end of a wippen 9, one end of which is pivotally mounted to the lower end of a center rail 8, is moved upward. The wippen 9 is pivoted counterclockwise and a jack 10 is then moved upward. Thereafter, a hammer butt 11 is pivoted counterclockwise about a pivot 12, and a hammer 13 is driven by the hammer butt 11 to strike a string 14. When the wippen 9 is pivoted counterclockwise, a damper spoon 16 mounted to one end of the wippen 9 is pivoted counterclockwise. A damper lever 17 is then rotated about a pivot 18 to separate a damper 19 from the string 14.

The hatched portion in FIG. 4 will be described. FIG. 5 shows this portion when viewed from the left. In the conventional upright piano, the damper spoon 16 is simply mounted at the end of wippen 9. In this embodiment, however, the damper spoon 16 is mounted at a peripheral portion of a ring 21, as shown in FIG. 5. The ring 21 is pivotally mounted at the end of the wippen 9. A rod member 22 is mounted on another peripheral portion of the ring 21 and is symmetrical about the damper spoon 16. Reference numeral 23 in FIG. 4 denotes a latching solenoid mounted on a bracket 24. A conical cam 25 is mounted at the distal end of the plunger of the solenoid 23. The inclined surface of the cam 25 abuts again the right side of the rod member 22. One end of a leaf spring 26 is connected to the lower surface of the wippen 9. The other end of the spring 26 abuts against the left side of the rod member 22.

With the above arrangement, when a negative pulse signal is applied to the solenoid, 23, the plunger of the solenoid 23 extends to move the cam 24 to the left in FIG. 4. The rod member 22 is then pivoted against the biasing force of the spring 26 in the direction of an arrow Y1 in FIG. 5. The damper spoon 16 is pivoted in the direction of the arrow Y1 accordingly. The distal end of the damper spoon 16 is brought into contact with the lower end of the damper lever 17. In this state, if the player depresses the key 5, the damper lever 17 is driven by the damper spoon 16 and the damper 19 is separated from the string 14. The hammer 13 then strikes the string 14 to produce a piano tone. However, when a positive pulse signal is applied to the solenoid 23, the plunger of the solenoid 23 is withdrawn to move the cam 24 to the right in FIG. 4. The rod member 22 is then pivoted by the biasing force of the spring 26 in the direction of an arrow Y2 of FIG. 5. The damper spoon 16 is pivoted in the direction of arrow Y2 accordingly. The distal end of the damper spoon 16 is removed from the damper lever 17. In this state, even if the player depresses the key 5 and the wippen 9 is pivoted, the damper lever 17 is not driven and the damper 19 is kept in contact with the string 14. As a result, no piano tone is produced even if the hammer 13 strikes the string 14. The above description concerns the piano tone production mechanism 3. In this embodiment, the above-mentioned piano action and the arrangement surrounded by the broken line applies to every key.

Figure 6:
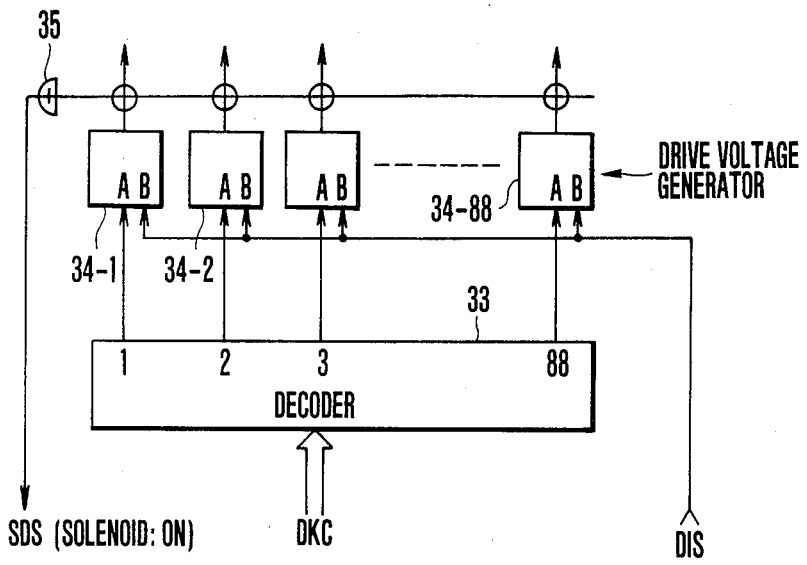
FIG. 6 is a block diagram of a solenoid driver 32 in FIG. 1.
Figure 7:
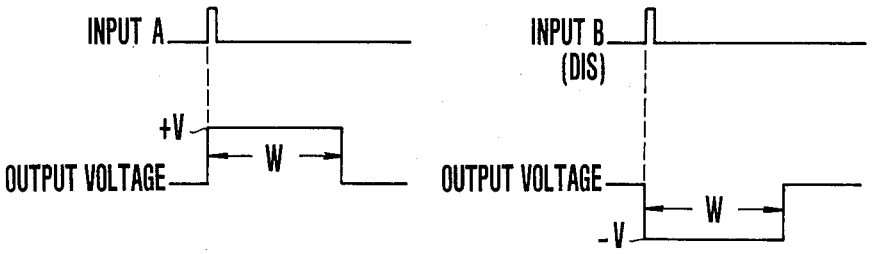
FIG. 7 is a timing chart for explaining the operation of drive voltage generators 34-1 to 34-88 in FIG. 6.

Returning to FIG. 1, reference numeral 30 denotes a key switch circuit. A key ON/OFF detection switch SW is arranged below each key 5 in FIG. 4. The key switch circuit 30 consists of the key switches SW and an interface circuit IF for sending each key switch output to a bus line BU. An operation member circuit 31 includes switches and volume controls for setting tone colors, musical effects, and so on of the electronic musical tones, as well as display elements and an interface circuit. A solenoid driver 32 is arranged to drive each solenoid 23 (FIG. 4) arranged in the piano tone production mechanism 3. As shown in FIG. 6, each solenoid driver 32 comprises a decoder 33, drive voltage generators 34-1 to 34-88, and an OR gate 35. The decoder 33 decodes a key code DKC supplied through the bus line BU. The drive voltage generators 34-1 to 34-88 generate positive pulse signals of a pulse width W upon reception of pulse signals to input terminals A thereof, and negative pulse signals of the pulse width W upon reception of pulse signals DIS to input -terminals B thereof through the bus line BU as shown in FIG. 7. Outputs from the drive voltage generators 34-1 to 34-88 are respectively supplied to the solenoids 23 arranged corresponding to the keys 5. It should be noted that the pulse width W is determined to be of a duration long enough to drive the solenoid 23. If at least one of the positive and/or negative outputs from the drive voltage generators 34-1 to 34-88 is supplied to the OR gate 35, the gate 35 sends a signal SDS ("1" signal) onto the bus line BU. It should be noted that the signal SDS is a solenoid ON signal.

A mode selection switch circuit 37 comprises the switches S1 to S4, the switches SS1 to SS4, the lamps L1 to L4, and the interface circuit, as described with reference to FIG. 2. Reference numeral 38 denotes a CPU (Central Processing Unit); 39, a ROM for storing a control program executed by the CPU 39; and 40, a processed data storage RAM. The registers in FIG. 8 are assigned in the RAM 40. A channel assignment register CHAR among these registers has N memory slots R-1 to R-N, as shown in FIG. 9. Each key code KC and a key ON bit KON ("1" or "0") are stored in each memory slot. The N memory slots respectively correspond to the N musical tone channels in a musical tone generator 42. The CPU 38, the ROM 39, and the RAM 40 constitute a microcomputer 41. The musical tone generator (TG) 42 generates a musical tone according to the data supplied through the bus line BU. The tone generator 42 has N musical tone channels, and each musical tone is produced in a corresponding channel. The resultant musical tone signals are mixed and supplied to a loudspeaker 43.

The operation of the keyboard musical instrument having the arrangement described above will be described with reference to the flow charts of the CPU 38 in FIGS. 10 to 12. In this embodiment, "1" is assigned as the key code KC of a first key (i.e., the lowest bass key). Similarly, "2", "3", . . . , "88" are sequentially assigned as key codes KC of the second, third, . . . , 88th keys, respectively.

When the player turns on the power switch and depresses one of the switches S1 to S4 in FIG. 2, an interrupt signal is supplied to the CPU 38. Upon reception of the interrupt signal, the CPU 38 write-accesses a mode register MODR in FIG. 8. More specifically, if the switch S1 is turned on, "1" is written as a mode number in the mode register MODR. If the switch S2 is turned on, "2" is written in the mode register MODR; and if switches S3 and S4 are turned on, "3" and "4" are respectively written therein. Even if at least two of the switches S1 to S4 are simultaneously depressed, one number is written in the mode register MODR according to a predetermined priority order. If the mode number in the mode register MODR is "1", the CPU 38 executes a split point input mode routine shown in FIG. 10. If the mode number is "2", the CPU 38 executes the piano play mode routine shown in FIG. 11; and if the mode number is "3" or "4", the CPU 38 executes an electronic musical instrument/split play mode routine shown in FIG. 12. These routines will be described hereinafter.

Figure 10:
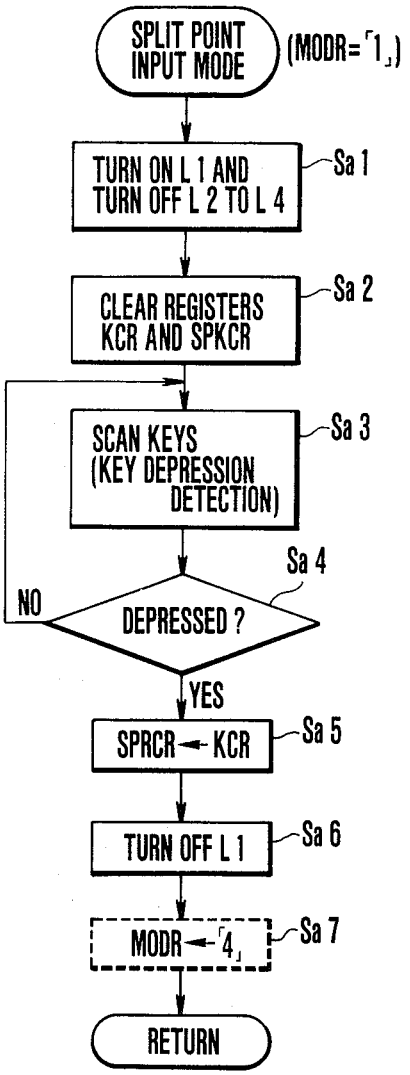
FIGS. 10 to 12 are flow charts for explaining the operation of a CPU 38 in FIG. 1.

(A) Split Point Input Mode Routine (FIG. 10)

When the CPU 38 advances to this routine, the CPU 38 supplies an ON instruction for the lamp L1 and an OFF instruction for the lamps L2 to L4 to the mode selection switch circuit 37 in step Sa1. Thus, only the lamp L1 is turned on. In step Sa2, a key scan register KCR and a split point register SPKCR in FIG. 8 are cleared. Key scan processing is performed in step Sa3. In this step, the key scan register KCR is incremented and data ("1" in this case) is read out therefrom and supplied as the key code to the key switch circuit 30. Upon reception of the key code KC "1", the key switch circuit 30 sends onto the bus line BU a signal of logic "1" if the key switch is ON and a signal of logic "0" if the key switch is OFF. The CPU 38 temporarily stores this data ("1" or "0") in a temporary storage register TEPR in FIG. 8. The flow then advances to step Sa4. In this step, the CPU 38 checks the data in the temporary storage register TEPR. If the data is logic "0" representing the key OFF state, the flow returns to step Sa3. The operations in steps Sa3 and Sa4 are repeated until a key ON signal is detected. However, if data in the register KCR represents "89" upon incrementation, this data is updated to "1". If a key ON signal is detected in step Sa4, the flow advances to step Sa5. In this step, data (i.e., the key code KC corresponding to the depressed key) is transferred from the key scan register KCR to the split point register SPKCR. In step Sa6, the CPU 38 sends the lamp OFF instruction for the lamp L1 to the mode selection switch circuit 37, and the lamp L1 is thus turned off. The routine returns to the main routine and the CPU 38 awaits the next interrupt signal. In the routine described above, step Sa7 may be inserted after step Sa6, and mode number "4" may be written in the mode register MODR. In this case, if the split point input mode is ended, the flow automatically returns to the split play mode.

Figure 11:
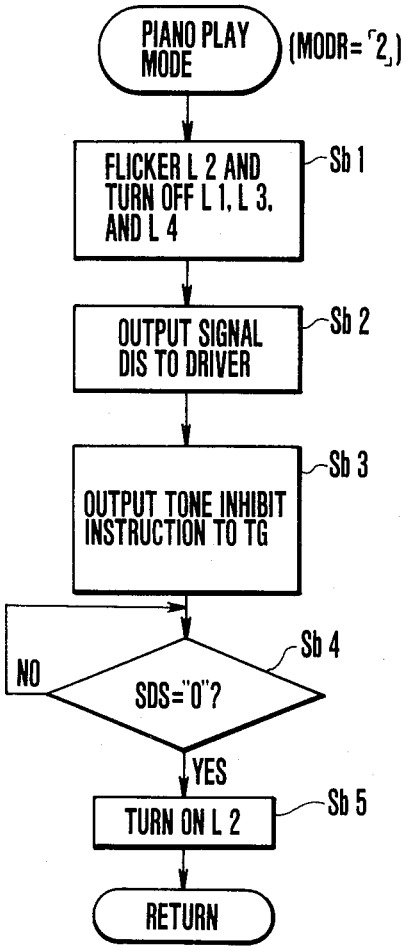

(B) Piano Play Mode Routine (FIG. 11)

When the CPU 38 advances to this routine, the CPU 38 supplies a flickering instruction for the lamp L2 and the OFF instruction for the lamps L1, L3, and L4 to the mode selection switch circuit 37 in step Sb1. Thus, only the lamp L2 flickers. In step Sb2, the CPU 38 sends the signal DIS to the solenoid drivers 32 in FIG. 6. The signal DIS is selectively supplied to the input terminals B of the drive voltage generators 34-1 to 34-88 for the solenoid drivers 32. The negative pulses from the energized ones of the generators 34-1 to 34-88 are supplied to the corresponding solenoids 23 of the piano tone production mechanism 3. The corresponding cams 25 at the distal ends of the plungers of the energized solenoids 23 extend to cause the distal ends of the corresponding damper spoons 16 to abut against the lower ends of the corresponding damper levers 17, thereby enabling the piano play mode. In step Sb3, the CPU 38 supplies a tone inhibit instruction to the tone generator 42. In step Sb4, the CPU 38 checks if the signal SDS from the solenoid driver 32 is set at "0". If NO in step Sb4, step Sb4 is repeated until the signal SDS is set at "0". In other words, if all solenoids 23 are deenergized, the flow advances to step Sb5. In step Sb5, the CPU 38 supplies the ON instruction for the lamp L2 to the mode selection switch circuit 37. The lamp L2 is thus kept ON. The flickering state of the lamp L2 is changed to the continuous ON state, informing the player that the piano play mode is enabled. The routine then returns to the main routine if the operations up to step Sb5 are completed. The CPU 38 then awaits the next interrupt signal.

Figure 12:
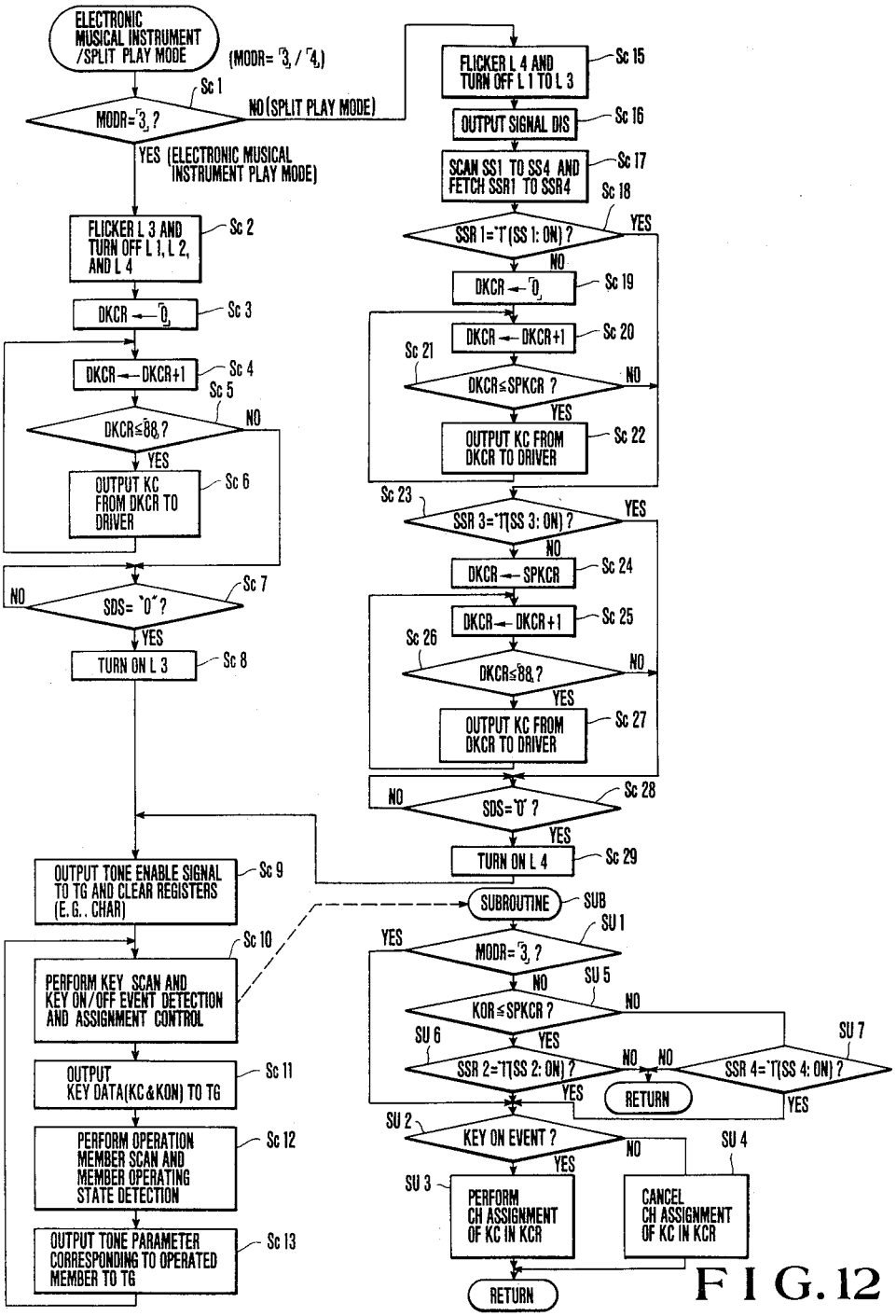

(C) Electronic Musical Instrument/Split Play Mode Routine (FIG. 12)

If the mode number in the mode register MODR is "3" or "4", the CPU 38 automatically executes this routine. First, a case will be described wherein the mode number in the mode register MODR is "3", i.e., the switch S3 is turned on to set the electronic musical instrument play mode. In step Sc1, the CPU 38 checks if the mode number in the register MODR is "3". If YES in step Sc1, the flow advances to step Sc2. In step Sc2, the CPU 38 sends the flickering instruction for the lamp L3 and the OFF instruction for the lamps L1, L2, and L4 to the mode selection switch circuit 37. Thus, the lamp L3 is flickered. In step Sc3, a damp register DKCR in FIG. 8 is cleared. In step Sc4, the damp register DKCR is incremented. The CPU 38 checks in step Sc5 if the content of the register DKCR is "88". If YES in step Sc5, the flow advances to step Sc6. In step Sc6, the data ("1" in this case) in the damp register DKCR is supplied as the key code DKC to the solenoid driver 32. When the key code DKC "1" is then supplied to the decoder 33 (FIG. 6) in the solenoid driver 32, a "1" signal is output from an output terminal 1 of the decoder 33. The "1" signal is supplied to the input terminal A of the drive voltage generator 34-1. The positive pulse is output from the drive voltage generator 34-1 to withdraw the plunger of the solenoid 23 arranged for the first key (the lowest bass key). The distal end of the corresponding damper spoon 16 is removed from the lower end of the corresponding damper lever 17. As a result, the piano tone is not produced from the first key.

The flow then returns to step Sc4, and the content of the damp register DKCR is incremented to "2". The flow advances to step Sc6 through step Sc5. Data "2" in the damp register DKCR is supplied to the solenoid drive circuit 32 of the second key. The positive signal is output from the corresponding drive voltage generator 34-2 (FIG. 6). The solenoid 23 for the second key is driven and the piano tone is not produced from the second key. The above operation is repeated to inhibit production of the piano tones from all the keys. If the content of the damp register DKCR is "89" in step Sc4, step Sc5 is determined to be NO. The flow advances to step Sc7. The CPU 38 checks in step Sc7 if the signal SDS is "0". If NO in step Sc7, i.e., if the solenoid 23 is being energized, the decision in step Sc7 is repeated. If YES in step Sc7, the flow advances to step Sc8. In step Sc8, the ON instruction for the lamp L3 is supplied to the mode selection switch circuit 37. The flickering state of the lamp L3 is then changed to the continuous ON state. Thus, the player is informed that the electronic musical instrument mode is engaged, and that he may actually use the keyboard.

When the user begins playing the instrument, the CPU 38 sends a tone enable signal to the tone generator 42 in step Sc9. The generator 42 is enabled in response to this signal. In this step, the channel assignment register CHAR, a key state register KSR, the key scan register KCR, and the like are also cleared. In step Sc10, key scanning and key ON/OFF event detection are performed. In the same manner as described above, the key switch corresponding to the value of the key scan register KCR is scanned to fetch data ("1" or "0" representing the ON/OFF state of the key switch. The fetched data is compared with the currently processed key switch data (i.e., the key switch corresponding to the KCR value) among the key switch ON/OFF data, thereby performing event detection (key state change detection) for the corresponding key switch. If key event change is not detected, the key scan register KCR is incremented to scan the next key switch. The same event detection as described above is then performed for this key switch.

However, if the key ON or OFF event is detected in the event detection described above, the key switch data subjected to this event and stored in the key state register is updated, and the flow advances to a subroutine SUB. In step SU1 in the subroutine SUB, the CPU 38 checks if the content of the mode register MODR is "3". If YES in step SU1, the flow advances to step SU2. The CPU 38 checks in step SU2 if the detected event is the key ON event. If YES in step SU2, the flow advances to step SU3. However, if NO in step SU2, the flow advances to step SU4. In step SU3, the key ON bits KON in the memory slots R-1, R-2, . . . R-N in the channel assignment register CHAR are sequentially scanned to detect an empty channel (i.e., the channel corresponding to the key ON bit KON of logic "0"). The value of the key scan register KCR, i.e., the key code of the newly turned-on key (i.e, the key ON bit KON "1"), is written in a memory slot R-K of the empty channel. In other words, channel assignment is performed. In step SU4, the value of the key scan register KCR, i.e., a memory slot R-M, for storing the key code KC of the OFF key, in the channel assignment register CHAR is detected. The key ON bit KON of logic "0" is stored in the memory slot R-M. When the operation in step SU3 or SU4 is completed, the flow returns to step Sc10. Thereafter, the key scan register KCR is incremented, the next key switch is scanned, and the same operation as described above is performed. The above operation is repeated for all key switches in the key switch circuit 30. When last (the 88th) key switch processing is completed, the flow advances to step Sc11.

In step Sc11, the content of the channel assignment register CHAR is transferred to the tone generator 42. The flow then advances to step Sc12. The operation members in the operation member circuit 31 is scanned to store operation state data of the members in the temporary storage register TEPR. In step Sc12, ON/OFF control of the display elements in the operation member circuit 31 is also performed. In step Sc13, the musical tone parameter corresponding to the operation member data in the temporary storage register TEPR is supplied to the tone generator 42. The tone generator 42 generates a musical tone signal corresponding to the ON key and the currently set tone color and musical effect in accordance with the key data (data in the channel assignment register CHAR) and musical tone parameters, which are transferred in steps Sc11 and SC13. The musical tone signal is supplied to the loudspeaker 43, thereby producing an electronic musical tone.

After the CPU 38 executes step Sc13, the flow returns to step Sc10 again. The operations in steps Sc10 to SC13 are repeated until an interrupt signal derived from the switches S1 to S4 (FIG. 2) is supplied to the CPU 38.

A case will be described wherein the mode number "4" is written in the mode register MODR, i.e., the switch S4 is turned on to set the split play mode.

In this case, since step Sc1 is determined to be NO, the flow advances to step Sc15. In step Sc15, the flickering instruction for the lamp L4 and the OFF instruction for the lamps L1 to L3 are supplied from the CPU 38 to the mode selection switch circuit 37. The lamp L4 flickers and the lamps L1 to L3 are turned off. The flow advances to step Sc16 and the signal DIS ("1" signal) is supplied to the respective solenoid drivers 32. The signal DIS is supplied to the input terminals B of the drive voltage generators 34-1 to 34-88 for the solenoid drivers 32. The negative pulses are then output from the drive voltage generators 34-1 to 34-88. The plungers of all the solenoids 23 extend and the piano play mode for all the keys is enabled. In step Sc17, the switches SS1 to SS4 (FIG. 2) in the mode selection switch circuit 37 are scanned to write "1"s or "0"s in switch registers SSR1 to SSR4 in FIG. 8 according to the ON/OFF states of the switches SS1 to SS4. The CPU 38 checks in step Sc18 if the content of the switch register SSR1 is "1" (i.e., if the switch SS1 is ON). If NO in step Sc18, i.e., if production of piano tones in the bass section is inhibited, the flow advances to step Sc19 and the damp register DKCR is cleared. In step Sc20, the register DKCR is incremented. In step Sc21, the CPU 38 checks if the content ("1" in this case) of the damp register DKCR is smaller than or equal to the data in the split point register SPKCR. If YES in step Sc21, the flow advances to step Sc22. In step Sc22, the data "1" in the damp register DKCR is supplied as the key code DKC to the solenoid driver 32. The "1" signal is then supplied to the input terminal A of the drive voltage generator 34-1 to apply the positive pulse signal to the solenoid 23 for the first key. The piano tone for the first key is not produced. The flow returns to step Sc20. The content of the damp register DKCR is incremented to "2" in step Sc 20. The flow advances to step Sc22 through step Sc21. The data "2" in the damp register DKCR is supplied to the corresponding solenoid driver 32 and the piano tone for the second key is not produced. The above operation is repeated to inhibit the production of piano tones for the third, fourth, . . . , 88th keys. If the data in the damp register DKCR is larger than that in the split point register SPKCR, step Sc21 is determined to be NO. The flow thus advances to step Sc23.

However, if YES in step Sc18, i.e., if the production of bass piano tones is designated, the flow directly advances to step Sc23. The CPU 38 checks in step Sc23 if the data in the switch register SSR3 is "1". If NO in step Sc23, i.e., production of treble piano tones is inhibited, the operations in steps Sc24 to SC27 are sequentially performed. More specifically, in step Sc24, data (the split point) in the split point register SPKCR is written in the damp register DKCR. In step Sc25, the data in the damp register DKCR is incremented. The CPU 38 checks in step Sc26 if the data in the damp register DKCR is smaller than or equal to "88". The data in the damp register DKCR is supplied to the solenoid driver 32 in step Sc27. The flow returns to step Sc25, and the operations in steps Sc25 to SC27 are repeated. In this manner, the treble piano tones are not produced. If the content of the damp register DKCR reaches "89", step Sc26 is determined to be NO, and the flow advances to step Sc28. However, if YES in step Sc23, the flow directly advances to step Sc28. In step Sc28, the CPU 38 checks if the signal SDS from the solenoid driver 32 is "0". If NO in step Sc28, step Sc28 is repeated. If YES in step Sc28, the flow advances to step Sc29. In step Sc29, the CPU 38 sends the ON instruction for the lamp L4 to the mode selection switch circuit 37. The flickering state of the lamp L4 is changed to the continuous ON state.

After step Sc9, the flow advances to step Sc10, and the operations in steps Sc10 to SC13 are repeated (i.e., the electronic musical tone generation processing). The operations in steps Sc10 to SC13 are substantially the same as described above (the case for the mode number "3"), except for the subroutine SUB.

In step Sc10, the key switches in the key switch circuit 30 are sequentially scanned to perform key ON/-OFF event detection. If an event is detected, the subroutine SUB is executed. In this case, step SU1 is determined to be NO, and the flow advances to step SU5. In step SU5, whether the key code KC in the key scan register KCR (FIG. 8), i.e., the key code KC subjected to the event detection, is smaller than or equal to the data in the split point register SPKCR is determined. If YES in step SU5, i.e., if the event key is a bass key, the flow advances to step SU6. The CPU 38 checks in step SU6 if the data in the switch register SSR2 is "1". If YES in step SU6, i.e., production of the bass electronic musical tone is designated, processing (tone generation assignment/assignment cancel processing) following step SU2 is performed. However, if NO in step SU6, the flow returns to step Sc10. If NO in step SU5, i.e., if the event key is a treble key, the flow advances to step SU7. The CPU 38 checks in step SU7 if the data in the register SSR4 is "1". If YES in step SU7 (i.e, production of the treble electronic musical tone is designated), the flow advances to step SU2. However, if NO in step SU7, the flow returns to step Sc10. The above operation, designed such that steps SU6 and SU7 are determined to be NO and the flow returns to step Sc10, indicates that the tone generation assignment is not set for the key ON event. In other words, the electronic musical tone is not produced in response to the key ON signal.

The present invention is not limited to the particular embodiment described above. Various changes and modifications may be made within the spirit and scope of the invention, such as those described below.

(1) The above embodiment exemplifies the combination of an upright piano and an electronic musical instrument. However, the electronic musical instrument may be combined with a grand piano.

Figure 13:
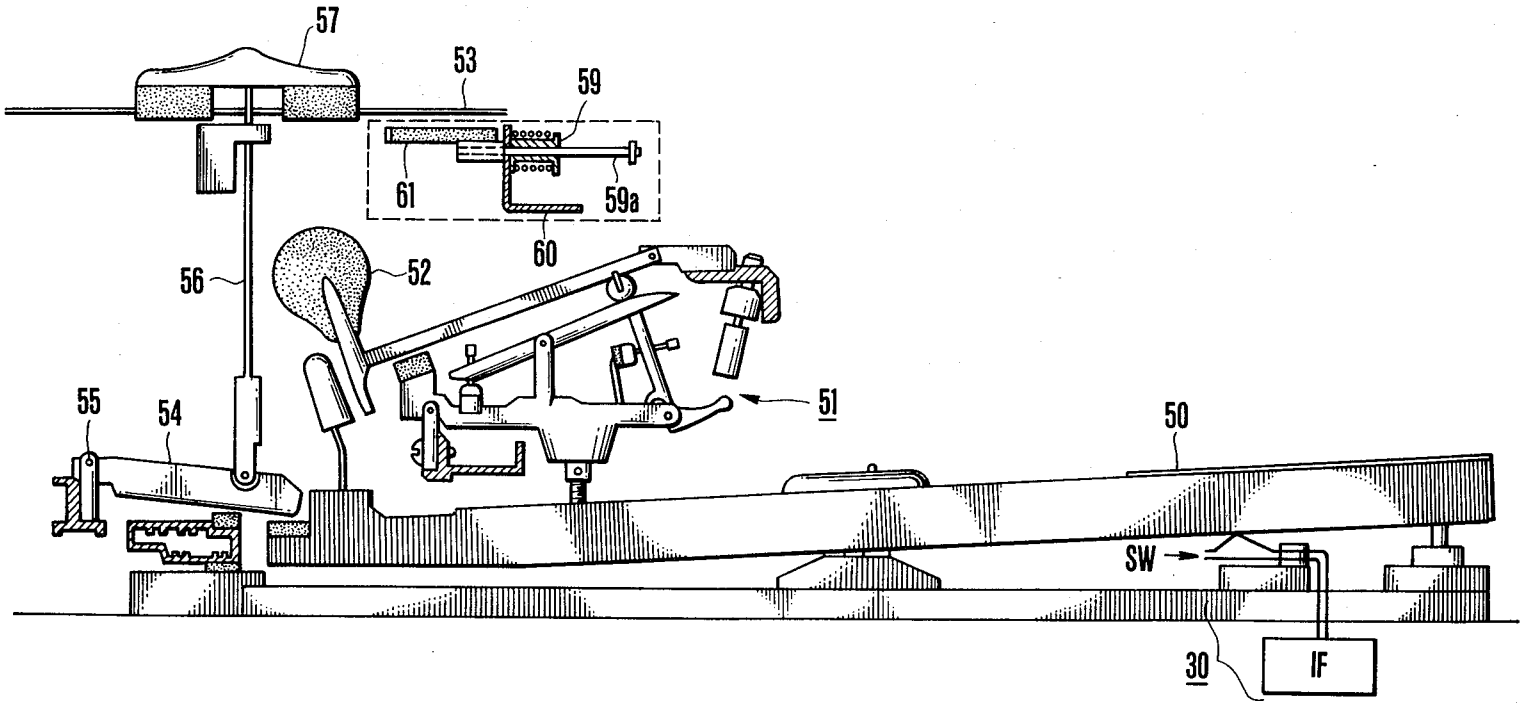
FIGS. 13 and 14 are sectional views showing other arrangements of the piano tone production mechanism 3 in FIG. 1.
Figure 14:
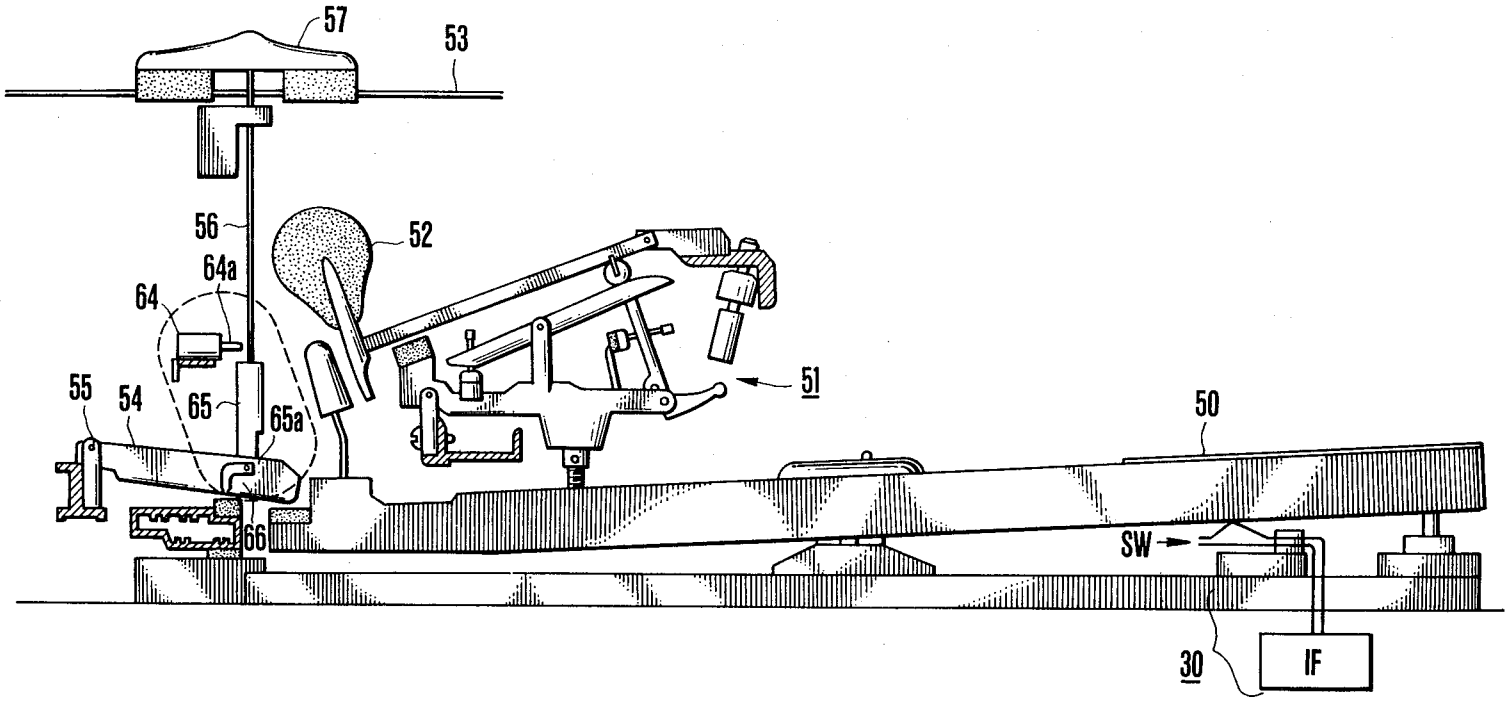

FIG. 13 shows a modification of the piano tone production mechanism 3, and FIG. 14 shows another modification thereof. The mechanisms in FIGS. 13 and 14 are the same as those of a conventional grand piano, except for portions surrounded by the broken lines. Referring to FIG. 13, when a player depresses a key 50, a hammer 52 is driven through an action mechanism 51 and strikes a string 53. In this case, a damper lever 54 is pivoted about a pivot 55 by the rear end portion of the key 50 to move a damper wire 56 upward. Therefore, a damper 57 is moved upward. The arrangement surrounded by the broken line will be described. Reference numeral 59 denotes a latching solenoid mounted on a bracket 60. A plate-like damper felt 61 is attached to one end of a plunger 59*a* of the solenoid 59. When a positive pulse is applied to the solenoid 59, the plunger 59*a* is moved to the left, as is the damper felt 61. The felt 61 is thus inserted between the hammer 51 and the string 53. Therefore, even if the player depresses the key 50, a piano tone is not produced. However, if a negative pulse is supplied to the solenoid 59, the plunger 59*a* is moved to the right and the piano tone can be produced.

Referring to FIG. 14, an annular member is mounted on the distal end of a plunger 64*a* of a latching solenoid 64. A damper wire 56 extends through the hole of the annular member. A projection 65*a* is formed on the lower end of the damper wire 56. The projection 65*a* is inserted in an inverted L-shaped guide hole 66 formed in a damper lever 54. When a negative pulse is supplied to the solenoid 64, the plunger 64*a* extends to the illustrated position. This piano tone production mechanism is operated in the same manner as that of the conventional grand piano. A piano tone is produced upon depression of a corresponding key 50. If a positive pulse is supplied to the solenoid 64, the plunger 64*a* is withdrawn and the projection 65*a* is moved in a vertical slot in the guide hole 66. When the key 50 is depressed and the damper lever 54 is pivoted, the projection 65*a* is moved only in the vertical slot. Therefore, the damper wire 56 is not moved upward, the damper 57 is not moved upward and the piano tone is not produced.

(2) In the above embodiment, a key touch strength (key depression strength) may be detected. In this case, the following contact mechanism is arranged below each key. A contact is released from a first terminal upon start of movement of the key, and is brought into contact with a second terminal when the key reaches its lowermost point. The key touch strength is detected by measuring the time required for movement of the contact between the first and second terminals.

(3) The split points may be designated independently for piano and electronic musical tones. In this case, the piano split point can be assigned for, e.g., the 20th key, and the electronic musical instrument split point can be assigned for the 30th key.

(4) The split point may be fixed.

(5) The keys are divided into the bass and treble keys in the above embodiment. However, three or more key regions may be specified.

(6) The tone production key regions (tone ranges) of the piano and electronic musical tones for all keys (tone ranges) of the keyboard can be arbitrarily and independently determined. For this purpose, the upper and lower limits of the key regions for the piano and electronic musical tones must be set using the keyboard in the same manner as in split point setting in the above embodiment.

(7) The split point may be designated not at the keyboard but by other means (e.g., a split point switch).

(8) The above embodiment exemplifies a microcomputer configuration. However, hardware may be replaced with software.

(9) The electronic musical instrument can be combined with a cembalo or organ in place of a piano.

(10) In the above embodiment, the tone generator 42 has channels whose number is smaller than the number of keys, and the key ON signal is assigned to an empty channel thereof. However, the tone generator 42 may be arranged to simultaneously generate the tones for all keys. In this case, steps SU3 and SU4 (the tone generation assignment processing/assignment cancel processing) in FIG. 12 are omitted. In addition, the tone generator 42 may generate a monophonic tone. In this case, the tone generation assignment processing/assignment cancel processing in steps SU3 and SU4 in FIG. 12 must be replaced with monophonic selection processing.

According to the present invention as described above, an acoustic musical tone such as a piano tone can be arbitrarily combined with an electronic musical tone, thereby providing a variety of musical expressions.

What is claimed is:

1. A keyboard musical instrument comprising:

a keyboard having a plurality of keys;

acoustic musical tone generating means for generating an acoustic musical tone by using a mechanical mechanism upon operation of a key;

electronic musical tone generating means for generating an electronic musical tone upon operation of a key;

tone designating means for designating a musical tone to be inhibited; and acoustic tone inhibiting means for automatically inhibiting generation of said acoustic musical tone from said acoustic musical tone generating means when said designated musical tone is said acoustic musical tone.

2. A keyboard musical instrument according to claim 1, wherein said acoustic musical tone is a piano tone.

3. A keyboard musical instrument according to claim 1, wherein said tone designating means includes range designating means for designating a key range to be inhibited, said acoustic tone inhibiting means inhibiting generation of an acoustic tone belonging to said designated key range of said designated musical tone.

4. A keyboard musical instrument according to claim 1, further comprising split point designating means for designating a split point of a key range, said key range being determined based on said designated split point, said acoustic tone inhibiting means inhibiting generation of an acoustic tone belonging to said determined key range of said designated musical tone.

* * * * *